United States Patent [19]

Fukushima

[11] Patent Number: 4,813,106

[45] Date of Patent: Mar. 21, 1989

[54] TELESCOPIC BUTTON

[75] Inventor: Jukichi Fukushima, Kurobe, Japan

[73] Assignee: Yoshida Kogyo K. K., Tokyo, Japan

[21] Appl. No.: 171,671

[22] Filed: Mar. 22, 1988

[30] Foreign Application Priority Data

Mar. 25, 1987 [JP] Japan ..... 62-69022

[51] Int. Cl.[4] ..... A44B 1/42

[52] U.S. Cl. ..... 24/91; 24/95

[58] Field of Search ..... 24/91, 92, 93, 94, 95, 24/104, 113 MP, 523, 686, 687

[56] References Cited

U.S. PATENT DOCUMENTS

| | | | |
|---|---|---|---|
| 549,434 | 11/1895 | Budd | 24/91 |
| 599,353 | 2/1898 | Parkinson | 24/91 |
| 1,191,944 | 7/1916 | Carley | 24/95 |
| 1,349,649 | 8/1920 | Arthur | 24/91 |
| 1,375,873 | 4/1921 | Waldes . | |
| 1,601,933 | 10/1926 | Warner . | |
| 1,821,616 | 9/1931 | Carley et al. . | |
| 1,968,221 | 7/1934 | Reiter . | |
| 3,262,670 | 7/1966 | Marlett | 24/523 |
| 4,512,063 | 4/1985 | Fukuroi | 24/95 |

FOREIGN PATENT DOCUMENTS

| | | | |
|---|---|---|---|
| 0179293 | 4/1986 | European Pat. Off. . | |
| 356785 | 8/1920 | Fed. Rep. of Germany . | |
| 51-10149 | 4/1976 | Japan . | |
| 2137476 | 10/1984 | United Kingdom . | |
| 2164834 | 4/1986 | United Kingdom | 24/95 |

*Primary Examiner*—Victor N. Sakran

*Attorney, Agent, or Firm*—Hill, Van Santen, Steadman & Simpson

[57] ABSTRACT

In a button which includes a button body and a tack member adapted to be joined with the button body when attaching the button to a garment fabric, the button body has a contractible and stretchable hollow hub in the form of a double tube composed of an outer tube integral with a button back and projecting downwardly therefrom and an inner tube separate from the button back and telescopically connected to the outer tube. A spring is mounted between the inner and outer tubes so as to normally urge the inner tube toward the button head.

4 Claims, 3 Drawing Sheets

TELESCOPIC BUTTON

BACKGROUND OF THE INVENTION

1. Field of the Invention

The present invention relates to a button suitable for a garment of a thick and strong fabric such as jean or denim, and more particularly to a button including a button body and a tack member adapted to be joined with the button body when attaching the button to the garment fabric.

2. Description of the Prior Art

A known button of the mentioned type, as disclosed in Japanese Patent Post-Examination Publication No. 51-10149 and illustracted here in FIG. 5 of the accompanying drawings, comprises a button body A' and a tack member B' adapted to be joined with the button body A' when attaching the button to a garment fabric F'. For attachment, a shank of the tack member B' is caused to pierce through the garment fabric F' and is then inserted into a hollow hub of the button body A' so as to deform or bend a tapering end of the shank, thus securing the shank to the hollow hub of the button body A'. The hollow hub of the button body A' is in the form of a double tube composed of concentric inner and outer tubes 3', 1' integrally joined at their rear or lower ends by an annular bottom portion 2' which is disposed against the garment fabric F' when the button body A' and the tack member B' are joined together. Since the inner and outer tubes 3', 1' are formed in a single integral piece from a sheet of metal, the height H' of the hollow hub of the button body, i.e. the distance between the lower surface of an annular top flange 6' of the button back and the lower surface of the annular bottom portion 2' of the hollow hub, is constant.

Having the constant-height hollow hub, the prior art button would be difficult or sometimes impossible to be fastened in a button hole of the garment if the garment fabric is thicker than usual. At that time, if the button head is forcibly threaded through the button hole, the garment fabric would be broken at portions around the button hole, thus impairing the fastening function of the button. Further, if the garment fabric F' is thinner than usual, a gap would remain between the lower surface of the annular top flange 6' of the button back and the upper surface of the garment fabric F' when the button head is threaded through the button hole, thus causing inadequate fastening function of the button.

Button makers have hitherto coped with this problem by supplying buttons of different heights to meet garment fabrics of different thickness, which would however result in an increased cost of production.

SUMMARY OF THE INVENTION

It is therefore an object of the present invention to provide a telescopic button in which a hollow hub of a button body is stretchable and contractible in conformity with the thickness of a garment fabric, thus guaranteeing smooth and accurate fastening of the button in the button hole.

According to a button of the present invention, a contractible and stretchable hollow hub of a button body is composed of an outer tube integral with a button back and projecting centrally therefrom, and an inner tube separate from the button back and telescopically connected to the outer tube. A spring is mounted between the inner and outer tubes so as to normally urge the inner tube toward the button head.

Many other advantages, features and additional objects of the present invention will become manifest to those versed in the art upon making reference to the detailed description and the accompanying sheets of drawings in which two preferred embodiments incorporating the principle of the present invention are shown by way of illustrative example.

DETAILED DESCRIPTION

Figure 1:
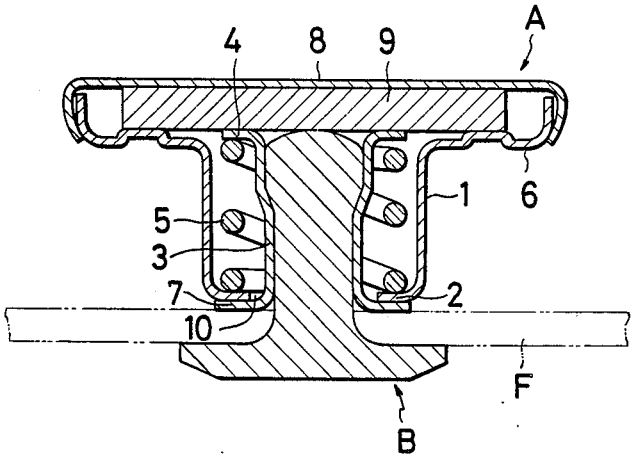
FIG. 1 is a vertical cross-sectional view of a button embodying the present invention, showing the button as attached to a garment fabric.

The principle of the present invention is particularly useful when embodied in a telescopic button (hereinafter referred to as "button") as shown in FIG. 1. The button generally comprises a button body A and a tack member B adapted to be joined with the button body A (in a manner described below) for attaching the button to a garment fabric F.

The button body A includes a button back having an annular top flange 6 having an annular rim covered by a cap 8. A back plate 9 is disposed between the button back and the cap 8, for a purpose described below. The button back also has a contractible and stretchable hollow hub in the form of a double tube that is composed of an outer tube 1 of circular cross section intergral with the button back and projecting downwardly from an inner edge of the annular top flange 6 and terminating in an inwardly directed bottom flange 2 and an inner tube 3 of circular cross section separate from the button back and telescopically connected to the outer tube 1. The inner tube 3 has an outwardly directed upper flange 4 at its front end and an outwardly directed lower flange 7 at its rear end. A coiled compression spring 5 is mounted between the upper flange 4 of the inner tube 3 and the bottom flange 2 of the outer tube 1 so as to normally urge the inner tube 3 toward the cap 8 (against the back plate 9).

Figure 2:
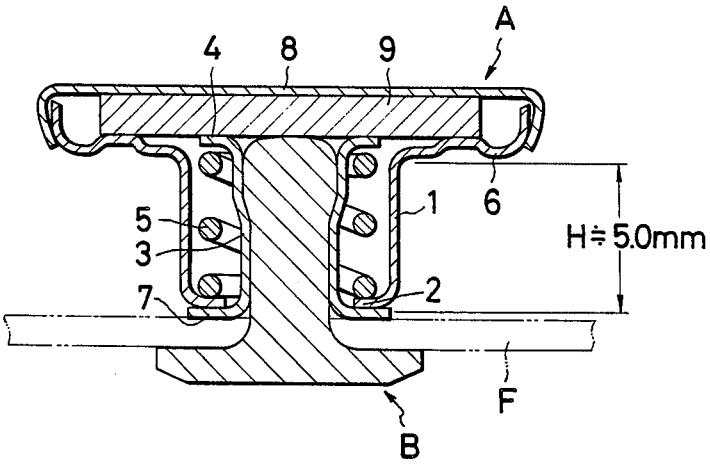
FIG. 2 is a view similar to FIG. 1 showing the button assuming a normal posture in which a hollow hub of the button is fully contracted.

When no upward pulling force is exerted on the button head or when the button head is threaded through a button hole (not shown) of the garment fabric F which has a relatively small thickness, the hollow hub of the bottom back assumes a fully contracted posture in which the lower flange 7 of the inner tube 3 abuts against the bottom flange 2 of the outer tube 1 under the resilience of the compression spring 5, as shown in FIGS. 1 and 2. Thus the bottom flange 2 of the outer tube 1 serves as a stop to restrict upward movement of the inner tube 3. In this normal or free condition, the height H of the hollow hub (the distance between the lower surface of the top flange 6 of the outer tube 1 and the upper surface of the lower flange 7 of the inner tube 3) is preferably about 5 mm.

Figure 3:
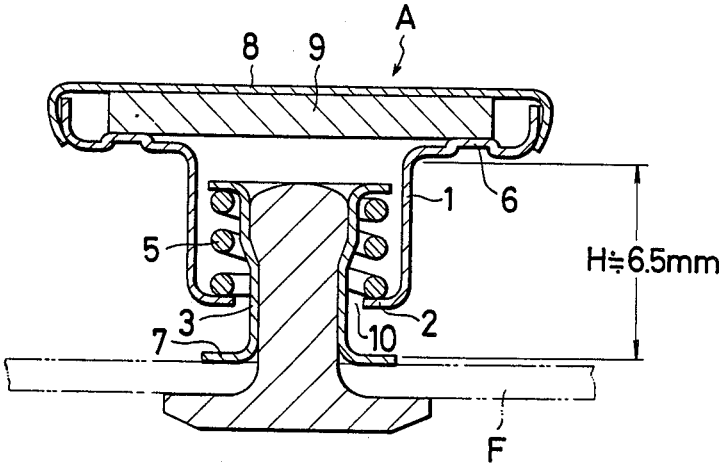
FIG. 3 is a view similar to FIG. 2, showing the button assuming a stretched posture in which the hollow hub of the button is stretched.

As shown in FIG. 3, when upward pulling force is exerted on the button head or when the button head is threaded through a button hole (not shown) of the garment fabric F which has a relatively large thickness, the hollow hub is stretched as the inner tube 3 projects from the lower end of the outer tube 1 against the resilience of the compression spring 3. In this stretched condition, the height H of the hollow hub is preferably about 6.5 mm.

As best shown in FIG. 3, there is a gap 10 between an inner edge of the bottom flange 2 of the outer tube 1 and a peripheral surface of the inner tube 3 so that the bottom head can be tilted with respect to the axis of the inner tube 3.

In the illustrated embodiment, each of the outer tube 1, the outer tube 3 and the cap 8 is made by pressing of a sheet of metal such as brass or iron, while each of the back plate 9 and the tack member B is made by diecasting of a metal such as zinc or iron.

Though there is no illustration here in the drawings, a leaf spring or rubber may be used as an alternative biasing means of the coiled compression spring 5.

For attaching the button to the garment fabric F, the shank (which initially has a tapering end portion) of the tack member B is caused to pierce through the garment fabric F and is then inserted into the inner tube 3. With continued insertion of the shank, the tapering end portion is bent or otherwise deformed as its distal end is forced against the back plate 9 disposed between the button back and the cap 8. As a result, the shank of the tack member B is permanently joined with the inner tube 3, which is telescopically connected to the outer tube 1.

Figure 4:
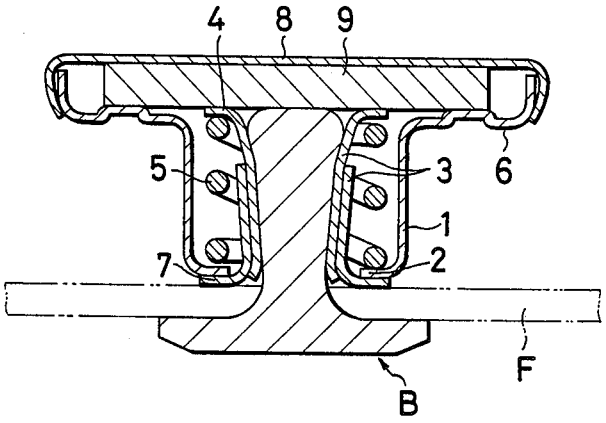
FIG. 4 is a vertical cross-sectional view of a modified button according to a second embodiment of the invention.
Figure 5:
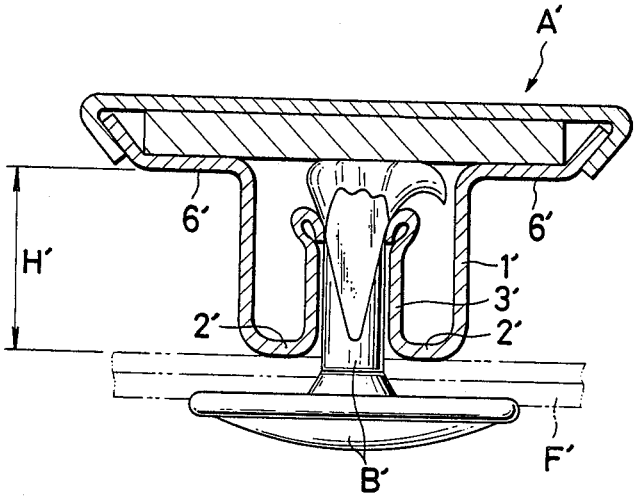
FIG. 5 PRIOR ART
FIG. 5 is a vertical cross-sectional view of a prior art button as attached to a garment fabric.

FIG. 4 illustrates a modified button according to a second embodiment, in which the inner tube 3 is composed of first and second tube members one fixedly fitted in the other.

With the button of the present invention, partly because the hollow hub of the button body is composed of the inner and outer tubes that are telescopically joined together and partly because the biasing means such as a spring is mounted between the inner and outer tubes, the hollow hub is contractible and stretchable as the inner tube is axially moved with respect to the outer tube. Thus the hollow hub of the button body has a variable height so that the button head can be threaded through a button hole of the garment fabric of either small or large thickness smoothly without impairing the fastening function of the button. Consequently, the button of the invention is suitable for both thin and thick garment fabrics; that is, it is possible to avoid the prior art problem that buttons of different height are required for garment fabrics of different thickness.

Further, since there is a gap between the inner edge of the bottom flange of the outer tube and the peripheral surface of the inner tube, the button head can be tilted with respect to the axis of the inner tube. Thus this button is particularly useful when used as a tiltable button. In the normal or free condition where no external force is exerted on the button body, the button head is prevented by the spring from dangling on the inner tube.

Although various minor modifications may be suggested by those versed in the art, it should be understood that I wish to embody within the scope of the patent warranted hereon, all such embodiments as reasonably and properly come within the scope of my contribution to the art.

I claim:

1. A telescopic button for attachment to a garment fabric, comprising:

(a) a button body including a button back and a cap covering said button back on its front side, said button back having a hollow hub disposed at its rear side, said hollow hub being composed of an outer tube integral with said button back and projecting centrally therefrom and terminating in an inwardly directed bottom flange and an inner inner tube separated from said button back and telescopicaly connected to said outer tube and having at its front end an outwardly directed upper flange;

(b) a coiled compression spring mounted between said bottom flange and said upper flange so as to normally urge the latter toward said cap; and (c) a tack member including a head and a shank projecting centrally from said head for being forced through the garment fabric and then being inserted into said inner tube for attaching the button to the garment fabric.

2. A telescopic button according to claim 1, in which said inner tube has at its rear end an outwardly directed lower flange normally urged against said bottom flange of said outer tube under the bias of said compression spring.

3. A telescopic button according to claim 1, in which said inner tube is composed of first and second tube members on fixedly fitted in the other.

4. A telescopic button according to claim 1, in which said button body includes a back plate disposed between said cap and said button back, said upper flange of said inner tube being normally urged against said back plate under the bias of said biasing means.

* * * * *